US010077129B2

(12) United States Patent
Riegel et al.

(10) Patent No.: US 10,077,129 B2
(45) Date of Patent: Sep. 18, 2018

(54) LABELER WITH SEALING LABEL PRESS-ON DEVICE

(71) Applicant: Multivac Marking & Inspection GmbH & Co. KG, Enger (DE)

(72) Inventors: Alexander Riegel, Enger (DE); Georg Austermeier, Hövelhof (DE)

(73) Assignee: MULTIVAC MARKING & INSPECTION GMBH & CO. KG, Enger (DE)

( * ) Notice: Subject to any disclaimer, the term of this patent is extended or adjusted under 35 U.S.C. 154(b) by 299 days.

(21) Appl. No.: 14/823,875

(22) Filed: Aug. 11, 2015

(65) Prior Publication Data

US 2016/0046401 A1 Feb. 18, 2016

(30) Foreign Application Priority Data

Aug. 13, 2014 (EP) ..... 14180771

(51) Int. Cl.
*B65C 1/04* (2006.01)
*B65C 9/36* (2006.01)

(52) U.S. Cl.
CPC . *B65C 9/36* (2013.01); *B65C 1/04* (2013.01)

(58) Field of Classification Search
None
See application file for complete search history.

(56) References Cited

U.S. PATENT DOCUMENTS

| | | | | |
|---|---|---|---|---|
| 2,854,164 | A * | 9/1958 | Triolo | B31B 50/00 156/477.1 |
| 3,513,058 | A | 5/1970 | Penick | |
| 3,558,403 | A | 1/1971 | Richie et al. | |
| 4,533,426 | A * | 8/1985 | Hoagland et al. | B65C 1/045 156/492 |
| 6,155,322 | A | 12/2000 | Landan et al. | |
| 2009/0056872 | A1 | 3/2009 | Grove | |

FOREIGN PATENT DOCUMENTS

| | | | |
|---|---|---|---|
| CH | 378776 | A | 6/1964 |
| DE | 4339778 | A1 | 6/1995 |
| DE | 102009039000 | A1 | 3/2011 |
| DE | 102014109853 | A * | 1/2016 |

OTHER PUBLICATIONS

Dictionary.com definition of circular. (Year: 2017).*

* cited by examiner

*Primary Examiner* — Barbara J Musser
(74) *Attorney, Agent, or Firm* — Husch Blackwell LLP

(57) ABSTRACT

The present invention relates to a labeler for applying labels to packages. The labeler can include a transport unit for transporting the packages, a label dispenser for applying a sealing label to a web-shaped rim of each of the packages, and a press-on device having a circularly movable pusher plate. The present invention also relates to a method of operating such a labeler, where the press-on device is provided for folding the sealing label around the web-shaped rim laterally to each package and for pressing the label onto the package.

17 Claims, 5 Drawing Sheets

LABELER WITH SEALING LABEL PRESS-ON DEVICE

CROSS-REFERENCE TO RELATED APPLICATIONS

This Application claims priority to European Patent Application Number 14180771.9 filed Aug. 13, 2014, to Alexander Riegel et al., currently pending, the entire disclosure of which is incorporated herein by reference.

FIELD OF THE INVENTION

The present invention relates to a labeler with a press-on device and to a method for applying labels to packages.

BACKGROUND OF THE INVENTION

U.S. Pat. No. 6,155,322 and German Patent Publication No. DE 10 2009 039 000 A1 disclose a labeler that applies a label to a web-shaped rim of a package so that the label is applied to the front of the package when the package is oriented transversely to the transport direction. According to U.S. Pat. No. 6,155,322, the label is pressed into a fillet on the upper and lower side of the web-shaped rim by means of two opposed press-on elements moving toward the applied label in a direction opposite to the transport direction. The package is then stopped by means of the press-on elements and its transport is not continued until the label has been pressed against the package and the press-on elements have been removed. Then, the label is pressed on in the area of the top and bottom surfaces by means of brushes arranged above and below the package. According to DE 10 2009 039 000 A1, only one press-on element is provided, which presses the label into a fillet below the rim by means of a parallel guide while the label is being pressed against the top surface of the package by means of a brush. These embodiments require sufficiently spaced-apart packages and their performance is therefore limited.

SUMMARY OF THE INVENTION

One object of the present invention is to provide an improved labeler for applying sealing labels to web-shaped rims of packages.

The labeler according to one embodiment of the present invention can include a transport unit for transporting packages and a label dispenser for applying a sealing label to a web-shaped rim of the package. The labeler can also include a press-on device with a circularly movable pusher plate. This can allow for folding and pressing on of the sealing label onto the lateral rim of the package during continuous operation of the labeler. The package need not be stopped during operation of the labeler, and consequently, it is not necessary to provide a distance between successive packages. A maximized performance (in the sense of the number of packages that can be labeled per unit time) for applying the sealing label around a web-shaped rim can thus be achieved. The sealing label can include a label that connects the upper part of a package to the lower part thereof, e.g. for holding a folded pack together and/or for necessitating a destruction of the label before the package can be opened.

According to a preferred embodiment of the present invention, a folding bar is provided for folding a free end of the sealing label, which is attached to the rim of the package, around the rim. The sealing label can, for example, be folded by approximately 90 degrees in the direction of the turned-away side of the already applied sealing label and the press-on device can carry out the subsequent folding at approximately 90 degrees and press the sealing label against the web-shaped rim.

The folding bar can include a bevel so that the free end of the sealing label, which can project beyond the rim of the package, can move into contact with the bevel while the package is being transported in the transport direction parallel to the folding bar and the press-on device.

According to one embodiment of the present invention, the folding bar is arranged on the press-on device in a stationary manner so that, together with a vertically adjustable press-on device, the folding bar can easily be adapted to various package sizes and thus to different layers of the rim.

The circular path of movement of the pusher plate can be produced by means of two jointly and synchronously driven disks having the pusher plate attached thereto by means of a holder. During the entire circular movement, a leading edge of the press-on device can remain approximately or precisely parallel to the transport direction and approximately or precisely parallel to the lateral rim of the package. According to one embodiment, the pusher plate is pivotable about a pivot axle of the holder, so that inaccuracies on the package, in particular on the rim of the package, can be reduced or eliminated. The pusher plate can also be adapted to be spring-loaded by means of compression springs so that a defined pressure during the press-on process can be adjusted.

The labeler can also include a downholder for the package, so that the two package halves (i.e., the upper part and the lower part of the package) can be held together while the sealing label is dispensed onto the lateral rim of the package, with a free end protruding laterally beyond the rim, and while the sealing label is being folded and pressed on.

The press-on device can be arranged laterally to the transport unit, so it can continuously press sealing labels against packages transported past the press-on device. The packages can move in direct succession and can be transported at speeds of up to 1 m/s, according to one embodiment of the present invention.

The pusher plate can be inclined relative to the transport plane of the transport unit by an angle which can prevent a collision between the leading edge of the pusher plate and the lateral rim of the packages. The larger the area of the sealing label's free end that is folded and pressed on, the closer the leading edge will approach the lower or upper surface of the web-shaped rim. A pusher plate with an inclination of about 5 to 10 degrees can be particularly suitable, according to one embodiment of the present invention. However, inclinations greater than or less than 5-10 degrees can also be suitable.

A method, according to one embodiment of the present invention, that can be used for operating a labeler having a transport unit for transporting packages, a label dispenser for applying a sealing label to a web-shaped rim of the package and a press-on device, is characterized in that the sealing label can be applied to the lateral web-shaped rim, which is oriented in the transport direction and that, subsequently, a free end of the label can be folded and pressed against the rim by means of a pusher plate of the press-on device. In this way, a stream of packages, with or without a distance between the individual packages, can be provided with a sealing label, which is applied around a web-shaped rim, continuously without having to change the transport speed. This can allow for extremely high performance.

According to one method of operating the labeler, the pusher plate is moved circularly so as to allow fast movements of the pusher plate. The pusher plate can also be moved transversely to the transport direction for carrying out the press-on process.

The sealing label can be dispensed onto the lower rim area of the package from below and the press-on device can fold the sealing label and press it against the upper rim area, according to one embodiment. According to another embodiment, the package is transported on the transport unit in an upright position and the sealing label is attached to the upper side and that the press-on movement of the pusher plate is an approximately vertical movement.

DESCRIPTION OF THE SEVERAL VIEWS OF THE DRAWING

In the accompanying drawing, which forms a part of the specification and is to be read in conjunction therewith in which like reference numerals are used to indicate like or similar parts in the various views.

Like components are designated by like reference numerals throughout the figures.

DETAILED DESCRIPTION OF THE INVENTION

Figure 1:
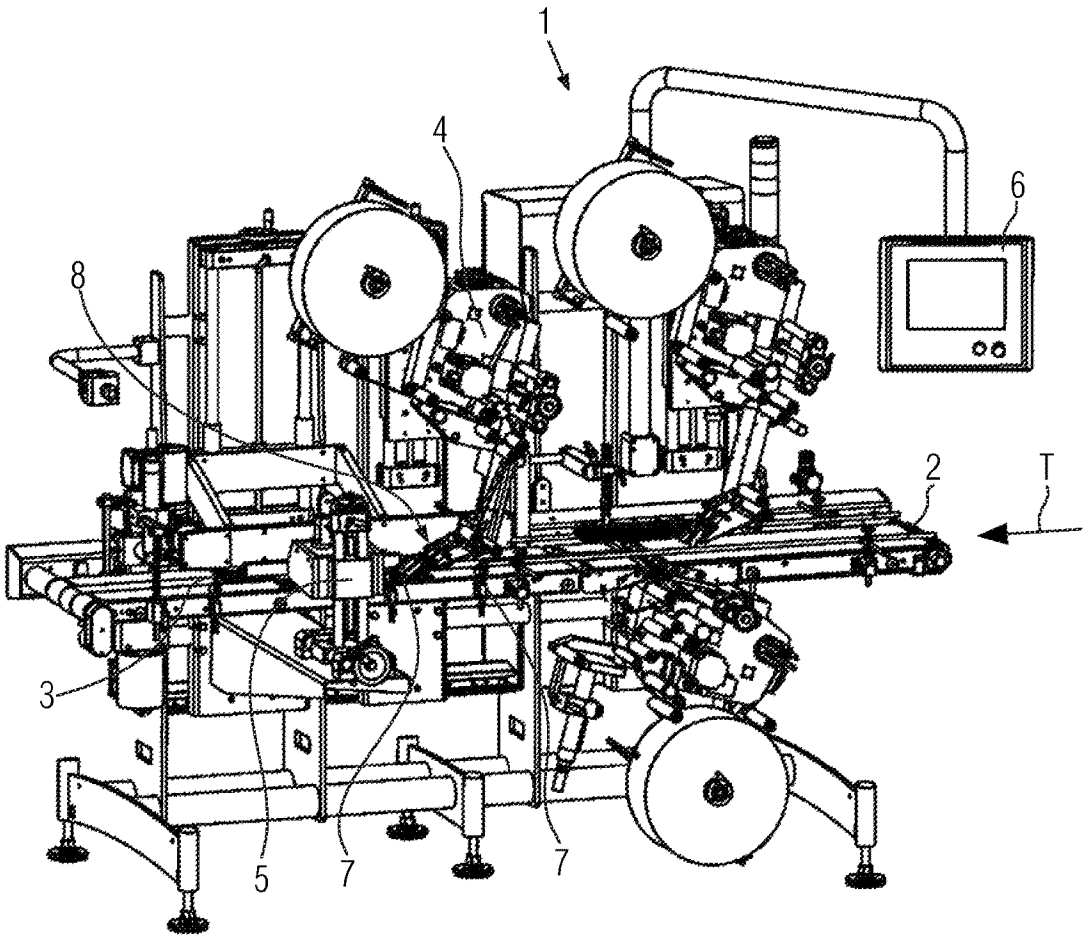
FIG. 1 is a side perspective view of a labeler in accordance with one embodiment of the present invention.

The invention will now be described with reference to the drawing figures, in which like reference numerals refer to like parts throughout. For purposes of clarity in illustrating the characteristics of the present invention, proportional relationships of the elements have not necessarily been maintained in the drawing figures.

The following detailed description of the invention references specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The present invention is defined by the appended claims and the description is, therefore, not to be taken in a limiting sense and shall not limit the scope of equivalents to which such claims are entitled.

FIG. 1 shows a labeler 1 according to one embodiment of the present invention. Labeler 1 can comprise a transport unit 2 for transporting packages 3 through the labeler 1 along a transport direction T on a label dispenser 4. Labeler 1 can include a press-on device 5 arranged downstream of the label dispenser 4 in the transport direction T. As shown in FIG. 1, labeler 1 can also include a control unit 6 that can receive information from sensors 7 arranged along the transport direction T, so as to detect the position of the package 3. The label dispenser 4 can comprise a dispensing unit 8 for dispensing individual sealing labels 9, as illustrated in FIG. 2, in the transport direction T.

Figure 2:
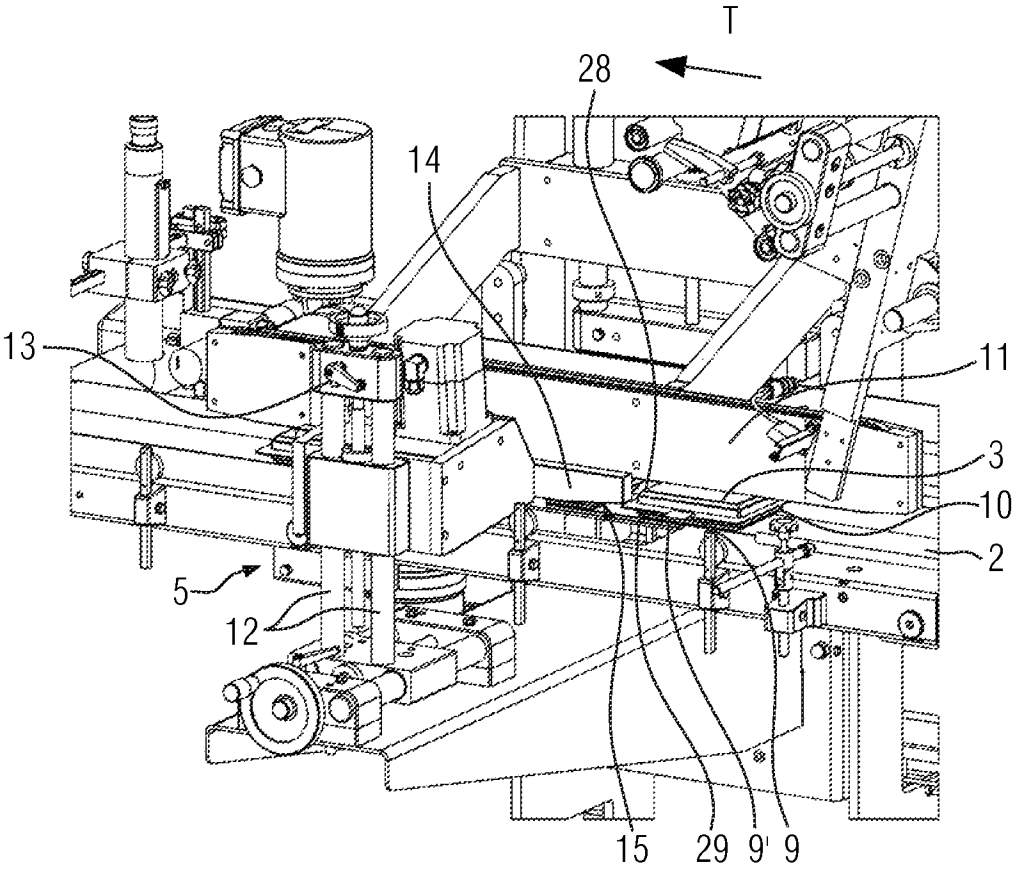
FIG. 2 is a partial enlarged side perspective view of a labeler with a press-on device in accordance with one embodiment of the present invention.

FIG. 2 shows an enlarged view of the press-on device 5 according to one embodiment of the present invention. FIG. 2 also shows a package 3, which can be a folded pack having a hinge on its back (not shown) and have a circumferentially extending web-shaped rim 10. The rim 10 can be defined by an upper rim area 28 of the upper package half and a lower rim area 29 of the lower package half. One or both of the upper rim area 28 and lower rim area 29 can be horizontally oriented as illustrated in FIG. 2. A downholder 11 can be positioned above the transport unit 2 and can hold the package 3 closed while a sealing label 9 is being applied to the upper rim area 28. The press-on device 5 can be vertically adjustable relative to the transport unit 2 by means of guide units 12 and a manual adjustment unit 13 so that the press-on device 5 can be adapted to the position of the rim 10 of the package 3 when the package 3 is being transported therealong. The press-on device 5 can have attached thereto a folding bar 14 with a bevel 15, as illustrated in FIG. 2, so that when a package 3 is being transported along the folding bar 14, a free end 9' of the sealing label 9 can be folded approximately 90 degrees downward around the rim 10 before the package 3, or rather the sealing label 9, reaches the press-on device 5.

Figure 3:
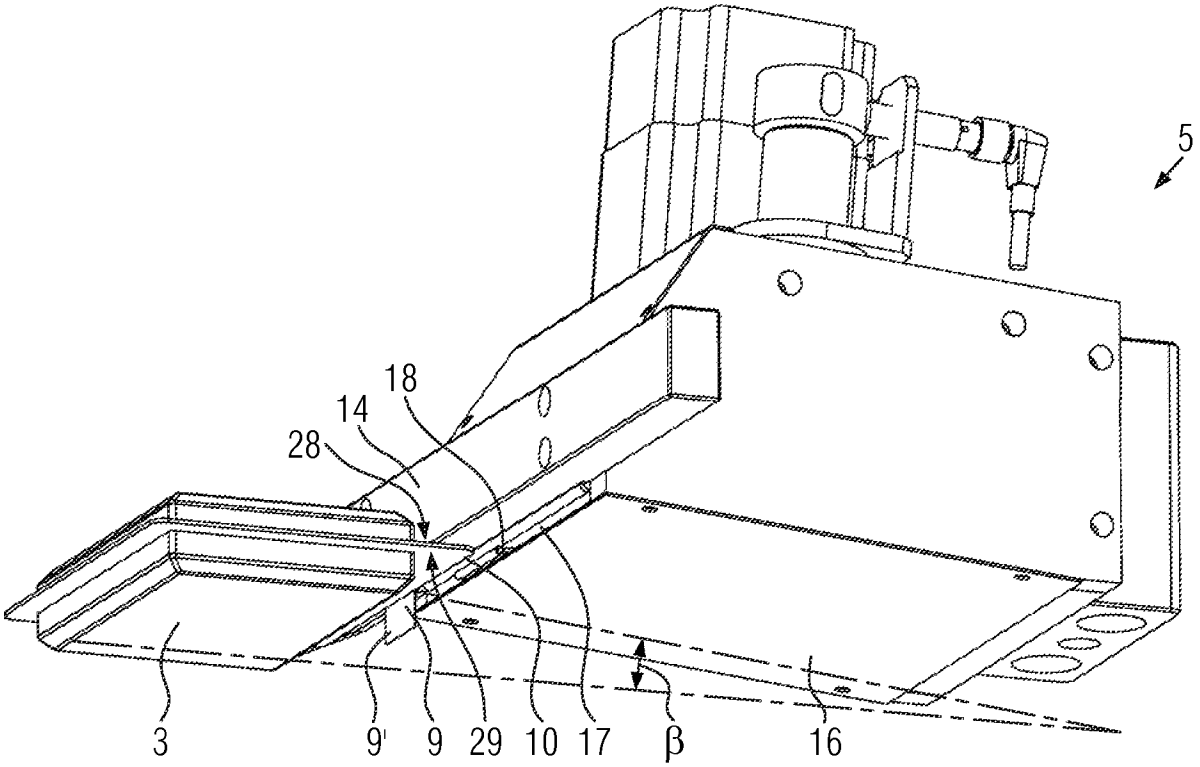
FIG. 3 is a bottom perspective view of the press-on device of FIG. 2.

FIG. 3 shows the press-on device 5, according to one embodiment of the present invention, in a view obliquely from below. According to such an embodiment, the folding bar 14 can be attached to the front of the press-on device 5 and the front of the folding bar 14 can face the transport unit 2, as best shown in FIG. 2. As best shown in FIG. 3, the upper surface of the label 9 can be applied to the upper rim area 28 of the package 3. When applied to the upper rim area 28, the upper surface of label 9 can be in contact with the lower surface of the folding bar 14 during transport in the transport direction T along the press-on device 5, thus acting also as a counter support while the free end 9' of the sealing label 9 is being pressed against the lower rim area 29 of the rim 10.

The press-on device 5 can be provided with a cover 16 on its bottom and can have an elongate opening 17 on its front, as shown in FIG. 3. The opening 17 can be oriented in the transport direction T as also shown in FIG. 3. A pusher plate 18 can be partially moved out of the opening 17 in the direction of the package 3. As shown in FIG. 3, the press-on device 5, or the pusher plate 18, can be inclined relative to the plane of transport of the transport unit 2 and thus relative to the bottom surface of the package 3 by an angle β. According to one embodiment, angle β can be approximately 5 to 10 degrees such that the press-on device 5, or the pusher plate 18, slopes at an oblique angle downwards in a direction facing away from the transport unit 2. Angle β can also be less than or greater than 5-10 degrees in alternative embodiments.

Figure 4:
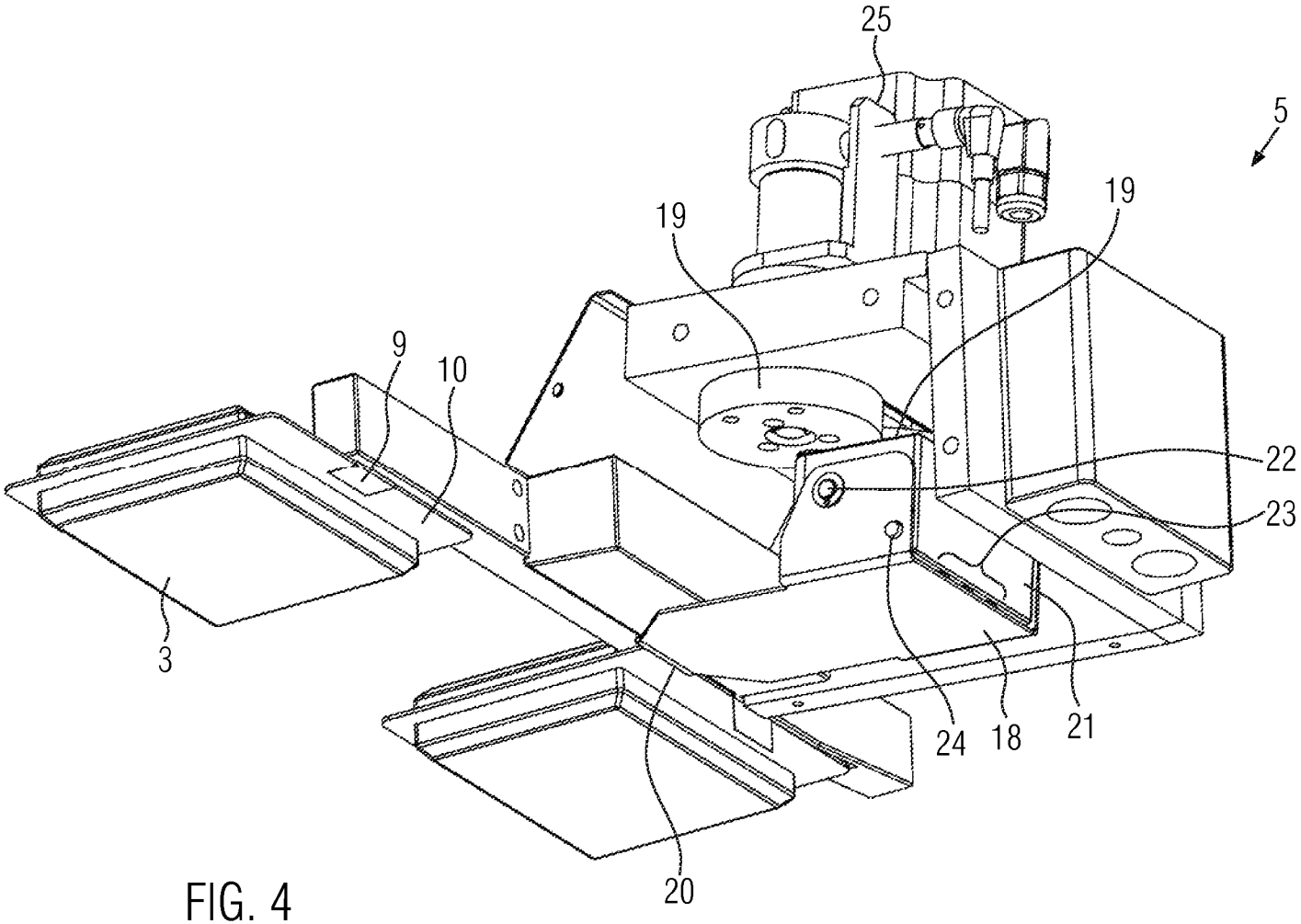
FIG. 4 is a bottom perspective view of the press-on device of FIG. 2 illustrating the press-on device without a cover.

FIG. 4 shows the press-on device 5 illustrated in FIG. 3 without the cover 16. As shown in FIG. 4, the pusher plate 18 can be supported on a holder 21 such that it is pivotable about a horizontal pivot axle 22. Pusher plate 18 can also be spring loaded by means of compression springs 23 against a stop 24. As shown in FIG. 4, the pusher plate 18 is supported by three compression springs 23. Fewer than three or greater than three compression springs 23 can be used in alternative embodiments. This configuration can allow a leading edge 20 of the pusher plate 18 to be deflected downwards and away from the package 3 against the compression springs 23. The force with which the leading edge 20 presses against the label 9 can be adjusted via the vertical position of the press-on device 5 relative to the rim 10 of the package 3. The holder 21 can be connected to disks 19, so as to be able to execute a rotary movement. FIG. 4 shows one embodiment of the present invention comprising two disks 19; however alternative configurations are also within the scope of the present invention. The disks 19 can be synchronously driven by a motor 25 via a gear unit, according to one embodiment of the present invention.

Figure 5:
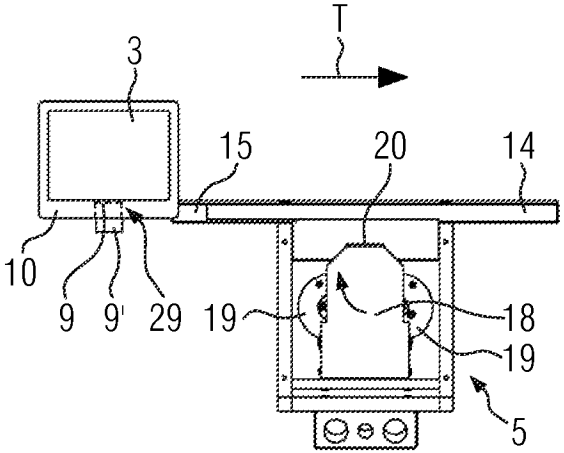
FIG. 5 is a bottom view of the press-on device of FIG. 2 illustrating the press-on device in a first position during a press-on process in accordance with one embodiment of the present invention.

In order to allow a more detailed explanation of the sequence of movements and of the press-on process, FIGS. 5 to 8 show four motion positions in a view from below of the press-on device 5, which is shown without the cover 16, and of the movement of the package 3, according to one particular embodiment of the present invention. In FIG. 5, the label 9 has been dispensed onto the upper rim area 28 of the rim 10 of the package 3 in this representation and the pusher plate 18 occupies a retracted position. The package 3 can be moved from the left to the right in the transport direction T by means of the transport unit 2, which is not shown in FIGS. 5 to 8.

During transport along the folding bar 14, the free end 9' of the sealing label 9 can be folded by approximately 90 degrees at the bevel 15 in a direction away from the drawing plane. The pusher plate 18 can be connected to the two synchronously rotating disks 19 via the holder 21 such that the pusher plate 18 executes a circular movement in a plane that is slightly inclined relative to horizontal. During this movement, the leading edge 20 can always be oriented approximately parallel to the transport direction T of the package 3 so that the label 9 will be pressed on linearly.

Figure 6:
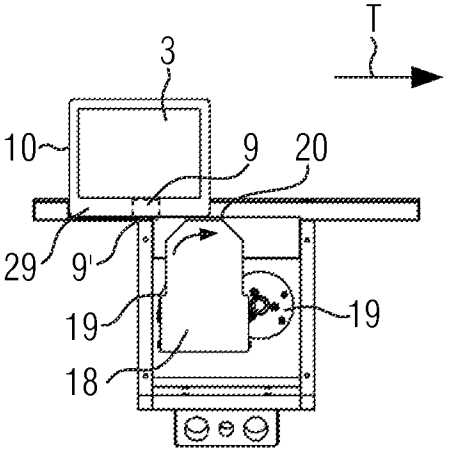
FIG. 6 is a bottom view of the press-on device of FIG. 5 illustrating the press-on device in a second position during the press-on process.
Figure 7:
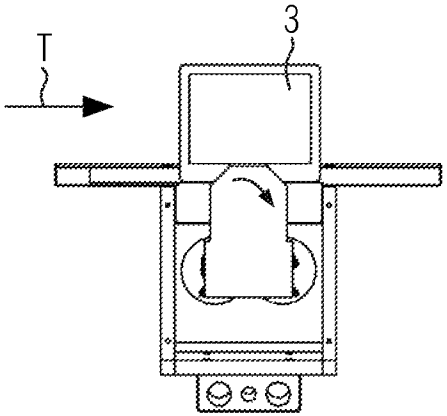
FIG. 7 is a bottom view of the press-on device of FIG. 5 illustrating the press-on device in a third position during the press-on process.

Between FIGS. 5 and 6, the two disks 19 and, consequently, the pusher plate 18 can rotate clockwise. As soon as the label 9 and the leading edge 20 have arrived at the position of FIG. 6, the further rotary movement of the pusher plate 18 and the transport movement of the package 3 can enable the leading edge 20 to approach relative to the package 3 and fold the free end 9' of the label 9 onto the lower rim area 29 of the rim 10 and press it on, as shown in FIG. 7. During this relative movement, it will be particularly advantageous when the motion component of the pusher plate 18 is synchronous with the transport speed of the package 3 in the transport direction T. As can be seen in FIG. 7, the pusher plate 18 can keep moving forward until its leading edge 20 has swept across the rim 10 of the package 3 in full width or at least almost in full width.

The sealing label 9 can then be folded around the edge and adhere to the upper rim area 28 and the lower rim area 29, which can protect the two package halves against unintentional opening (i.e. a destroyed sealing label 9 indicating that the package 3 has already been opened). The control unit 6 shown in FIG. 1 can control the movement of the pusher plate 18 by means of the information obtained from the sensors 7 and the speed of the transport unit 2.

Figure 8:
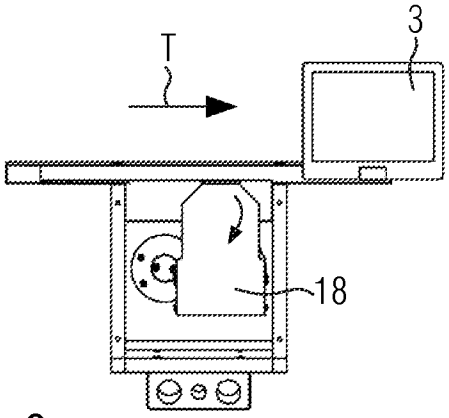
FIG. 8 is a bottom view of the press-on device of FIG. 5 illustrating the press-on device in a fourth position during the press-on process.

In FIG. 8, the package 3 is transported further and the pusher plate 18 is returned to the retracted position during the continued rotary movement.

From the foregoing, it will be seen that this invention is one well adapted to attain all the ends and objects hereinabove set forth together with other advantages which are obvious and which are inherent to the structure. It will be understood that certain features and sub combinations are of utility and may be employed without reference to other features and sub combinations. This is contemplated by and is within the scope of the claims. Since many possible embodiments of the invention may be made without departing from the scope thereof, it is also to be understood that all matters herein set forth or shown in the accompanying drawings are to be interpreted as illustrative and not limiting.

The constructions and methods described above and illustrated in the drawings are presented by way of example only and are not intended to limit the concepts and principles of the present invention. Thus, there has been shown and described several embodiments of a novel invention. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A labeler comprising:

a transport unit for transporting packages;

a label dispenser for applying a sealing label to a web-shaped rim of each package; and a press-on device having a circularly movable pusher plate;

wherein the circular movement of the pusher plate is produced by two synchronously driven disks having the pusher plate attached thereto by a holder.

2. The labeler according to claim 1 further comprising a folding bar for folding a free end of the sealing label around the web-shaped rim of each package after the sealing label has been attached to the web-shaped rim the package.

3. The labeler according to claim 2, wherein the folding bar has a bevel.

4. The labeler according to claim 2, wherein the folding bar is positioned on the press-on device in a stationary manner.

5. The labeler according to claim 1, wherein the pusher plate is pivotable about a pivot axle of the holder.

6. The labeler according to claim 1, wherein the pusher plate is spring-loaded by at least one compression spring.

7. The labeler according to claim 1 further comprising a downholder for positioning the packages.

8. The labeler according to claim 1, wherein the press-on device is positioned laterally with respect to the transport unit.

9. The labeler according to claim 1, wherein the pusher plate is inclined relative to a transport plane of the transport unit by an angle.

10. A labeler comprising:

a transport unit for transporting packages in a transport direction;

a label dispenser for applying a sealing label to a web-shaped rim of the package;

a press-on device, wherein the press on device has a pusher plate disposed for a circular movement during operation of the labeler, wherein during the entire circular movement a leading edge of the pusher plate is disposed parallel to one of the transport direction or to the web-shaped rim of the package; and a folding bar for folding a free end of the sealing label around the web-shaped rim of each package after the sealing label has been attached to the web-shaped rim the package, wherein the folding bar has a bevel.

11. The labeler according to claim 10, wherein the circular movement of the pusher plate is produced by two synchronously driven disks having the pusher plate attached thereto by a holder.

12. The labeler according to claim 11, wherein the pusher plate is pivotable about a pivot axle of the holder.

13. The labeler according to claim 10, wherein the pusher plate is spring-loaded by at least one compression spring.

14. The labeler according to claim 10 further comprising a downholder for positioning the packages.

15. The labeler according to claim 10, wherein the press-on device is positioned laterally with respect to the transport unit.

16. The labeler according to claim 10, wherein the pusher plate is inclined relative to a transport plane of the transport unit by an angle.

17. A labeler comprising:

a transport unit for transporting packages in a transport direction;

a label dispenser for applying a sealing label to a web-shaped rim of the package;

a press-on device, wherein the press on device has a pusher plate disposed for a circular movement during operation of the labeler, wherein during the entire circular movement a leading edge of the pusher plate is disposed parallel to one of the transport direction or to the web-shaped rim of the package; and a folding bar for folding a free end of the sealing label around the web-shaped rim of each package after the sealing label has been attached to the web-shaped rim the package, wherein the folding bar is positioned on the press-on device in a stationary manner.

* * * * *